US009978236B2

(12) United States Patent
Casanova et al.

(10) Patent No.: US 9,978,236 B2
(45) Date of Patent: May 22, 2018

(54) SELF-DETACHING ANTI-THEFT DEVICE WITH POWER REMOVAL STATION

(71) Applicants: Jose Casanova, Coral Springs, FL (US); Sergio M. Perez, Lake Worth, FL (US); John J. Clark, Boynton Beach, FL (US); Randy J. Zirk, Delray Beach, FL (US)

(72) Inventors: Jose Casanova, Coral Springs, FL (US); Sergio M. Perez, Lake Worth, FL (US); John J. Clark, Boynton Beach, FL (US); Randy J. Zirk, Delray Beach, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 15 days.

(21) Appl. No.: 15/179,261

(22) Filed: Jun. 10, 2016

(65) Prior Publication Data

US 2016/0364969 A1 Dec. 15, 2016

Related U.S. Application Data

(60) Provisional application No. 62/174,780, filed on Jun. 12, 2015.

(51) Int. Cl.
*G08B 13/24* (2006.01)
*E05B 73/00* (2006.01)

(52) U.S. Cl.
CPC ..... *G08B 13/2434* (2013.01); *E05B 73/0017* (2013.01); *E05B 73/0047* (2013.01); *G08B 13/242* (2013.01)

(58) Field of Classification Search
CPC .. G08B 13/2434; G08B 13/246; G08B 13/14; G08B 13/242; G08B 13/2411;
(Continued)

(56) References Cited

U.S. PATENT DOCUMENTS 5,942,978 A * 8/1999 Shafer ..... E05B 73/0017 340/10.5
5,955,951 A * 9/1999 Wischerop ..... E05B 73/0017 340/10.42
(Continued)

FOREIGN PATENT DOCUMENTS

GB 2340873 A 3/2000
GB 2530591 A * 3/2016 ..... E05B 73/0017

OTHER PUBLICATIONS

PCT International Search Report and Written Opinion of the International Searching Authority (EPO) for International Application No. PCT/US2016/037001 (dated Sep. 21, 2016).

*Primary Examiner* — An T Nguyen
(74) *Attorney, Agent, or Firm* — Fox Rothschild LLP; Robert J. Sacco; Carol E. Thorstad-Forsyth

(57) ABSTRACT

Systems and methods for operating a security tag. The methods involve: establishing an electrical connection between the security tag and an external Power Removal Station ("PRS"); performing operations by the security tag to authenticate a detach command sent from the external PRS; allowing power to be supplied from the external PRS to an electro-mechanical component of the security tag when the detach command is authenticated; and actuating the electro-mechanical component so that a pin of the security tag transitions from an engaged position to an unengaged position without any human assistance or mechanical assistance by a device external to the security tag.

16 Claims, 11 Drawing Sheets

(58) Field of Classification Search
CPC ..... G08B 13/2437; G08B 7/0008; G08B 19/0723; E05B 73/0017; E05B 73/0052; E05B 73/0023; E05B 73/0041
See application file for complete search history.

(56) References Cited

U.S. PATENT DOCUMENTS

| | | | | |
|---|---|---|---|---|
| 7,215,250 | B2 * | 5/2007 | Hansen | E05B 73/0017 340/572.8 |
| 7,812,706 | B2 | 10/2010 | Suzuki et al. | |
| 8,094,026 | B1 | 1/2012 | Green | |
| 2002/0024440 | A1 * | 2/2002 | Okuno | E05B 73/0017 340/572.1 |
| 2003/0140662 | A1 | 7/2003 | Hsu | |
| 2004/0100385 | A1 * | 5/2004 | Hansen | E05B 73/0017 340/572.9 |
| 2005/0190060 | A1 * | 9/2005 | Clancy | G08B 13/246 340/572.9 |
| 2007/0131005 | A1 | 6/2007 | Clare | |
| 2008/0100457 | A1 | 5/2008 | Gray | |
| 2010/0188227 | A1 * | 7/2010 | Yang | G08B 13/1463 340/572.1 |
| 2011/0227706 | A1 | 9/2011 | Yang | |
| 2014/0091932 | A1 * | 4/2014 | Mohiuddin | G08B 13/246 340/572.1 |
| 2014/0091933 | A1 * | 4/2014 | Mohiuddin | G08B 13/246 340/572.1 |
| 2014/0253333 | A1 * | 9/2014 | Patterson | E05B 73/0064 340/572.4 |
| 2015/0013398 | A1 | 1/2015 | Taylor | |
| 2015/0048946 | A1 | 2/2015 | Luo | |
| 2016/0260303 | A1 * | 9/2016 | Strulovitch | G08B 13/2434 |
| 2016/0364969 | A1 * | 12/2016 | Casanova | E05B 73/0047 |
| 2017/0030109 | A1 | 2/2017 | Duncan et al. | |

* cited by examiner

SELF-DETACHING ANTI-THEFT DEVICE WITH POWER REMOVAL STATION

CROSS-REFERENCE TO RELATED APPLICATIONS

This application claims priority to U.S. Patent Application No. 62/174,780, filed Jun. 12, 2015. The contents of the above application are incorporated by reference in its entirety.

FIELD OF THE INVENTION

This document relates generally to security tags used in Electronic Article Surveillance ("EAS") systems. More particularly, this document relates to security tags and methods for facilitating a self-detaching of a security tag using a power removal station.

BACKGROUND OF THE INVENTION

A typical EAS system in a retail setting may comprise a monitoring system and at least one security tag or marker attached to an article to be protected from unauthorized removal. The monitoring system establishes a surveillance zone in which the presence of security tags and/or markers can be detected. The surveillance zone is usually established at an access point for the controlled area (e.g., adjacent to a retail store entrance and/or exit). If an article enters the surveillance zone with an active security tag and/or marker, then an alarm may be triggered to indicate possible unauthorized removal thereof from the controlled area. In contrast, if an article is authorized for removal from the controlled area, then the security tag and/or marker thereof can be detached therefrom. Consequently, the article can be carried through the surveillance zone without being detected by the monitoring system and/or without triggering the alarm.

Radio Frequency Identification ("RFID") systems may also be used in a retail setting for inventory management and related security applications. In an RFID system, a reader transmits a Radio Frequency ("RF") carrier signal to an RFID device. The RFID device responds to the carrier signal with a data signal encoded with information stored by the RFID device. Increasingly, passive RFID labels are used in combination with EAS labels in retail applications.

As is known in the art, security tags for security and/or inventory systems can be constructed in any number of configurations. The desired configuration of the security tag is often dictated by the nature of the article to be protected. For example, EAS and/or RFID labels may be enclosed in a rigid tag housing, which can be secured to the monitored object (e.g., a piece of clothing in a retail store). The rigid housing typically includes a removable pin which is inserted through the fabric and secured in place on the opposite side by a mechanism disposed within the rigid housing. The housing cannot be removed from the clothing without destroying the housing except by using a dedicated removal device.

A typical retail sales transaction occurs at a fixed Point Of Sale ("POS") station manned by a store sales associate. The store sales associate assists a customer with the checkout process by receiving payment for an item. If the item is associated with an EAS/RFID element, the store sales associate uses the dedicated removal device to remove the security tag from the purchased item.

A retail sales transaction can alternatively be performed using a mobile POS unit. Currently, there is no convenient way to detach a security tag using a mobile POS unit. Options include: the use of a mobile detacher unit in addition to a mobile POS unit; the use of a fixed detacher unit located within the retail store which reduces the mobility of the mobile POS unit; or the use of a fixed detacher unit located at an exit of a retail store which burdens customers with a post-POS task. None of these options is satisfactory for large scale mobile POS adaption in a retail industry.

SUMMARY OF THE INVENTION

This document concerns systems and methods for operating a security tag. The methods involve: establishing an electrical connection between the security tag and an external Power Removal Station ("PRS"); performing operations by the security tag to authenticate a detach command sent from the external PRS; allowing power to be supplied from the external PRS to an electro-mechanical component (e.g., a solenoid or a motor) of the security tag when the detach command is authenticated; and actuating the electro-mechanical component so that a pin of the security tag transitions from an engaged position to an unengaged position without any human assistance or mechanical assistance by a device external to the security tag. The detach command can be sent from the external PRS to the security tag when a verification has been made that an article to which the security tag is attached has been successfully purchased. Also, the power can be supplied to the electro-mechanical component by actuating a switch of the security tag.

In some scenarios, the pin is fixedly coupled to the security tag's housing. An end of the pin resides within an aperture formed in a first portion of the security tag at least partially spaced apart from a second portion of the security tag by a gap when the pin is in the engaged position. In contrast, the pin is fully retracted into the second portion of the security tag when the pin is in the unengaged position. The gap is sized and shaped to prevent a user's access to the pin while the security tag is being coupled to the article at least partially inserted into the gap.

Other methods for operating a security tag involve: establishing an electrical connection between the PRS and the security tag; receiving by the PRS a signal sent from a computing device when a verification has been made that an article to which the security tag is attached has been successfully purchased; and supplying power from the PRS to the security tag in response to the PRS's reception of the signal so as to enable actuation of a mechanical component of the security tag, whereby a pin of the security tag transitions from an engaged position to an unengaged position without any human assistance or mechanical assistance by a device external to the security tag. The mechanical component is actuated upon authentication of a detach command sent from the PRS and received at the security tag.

DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
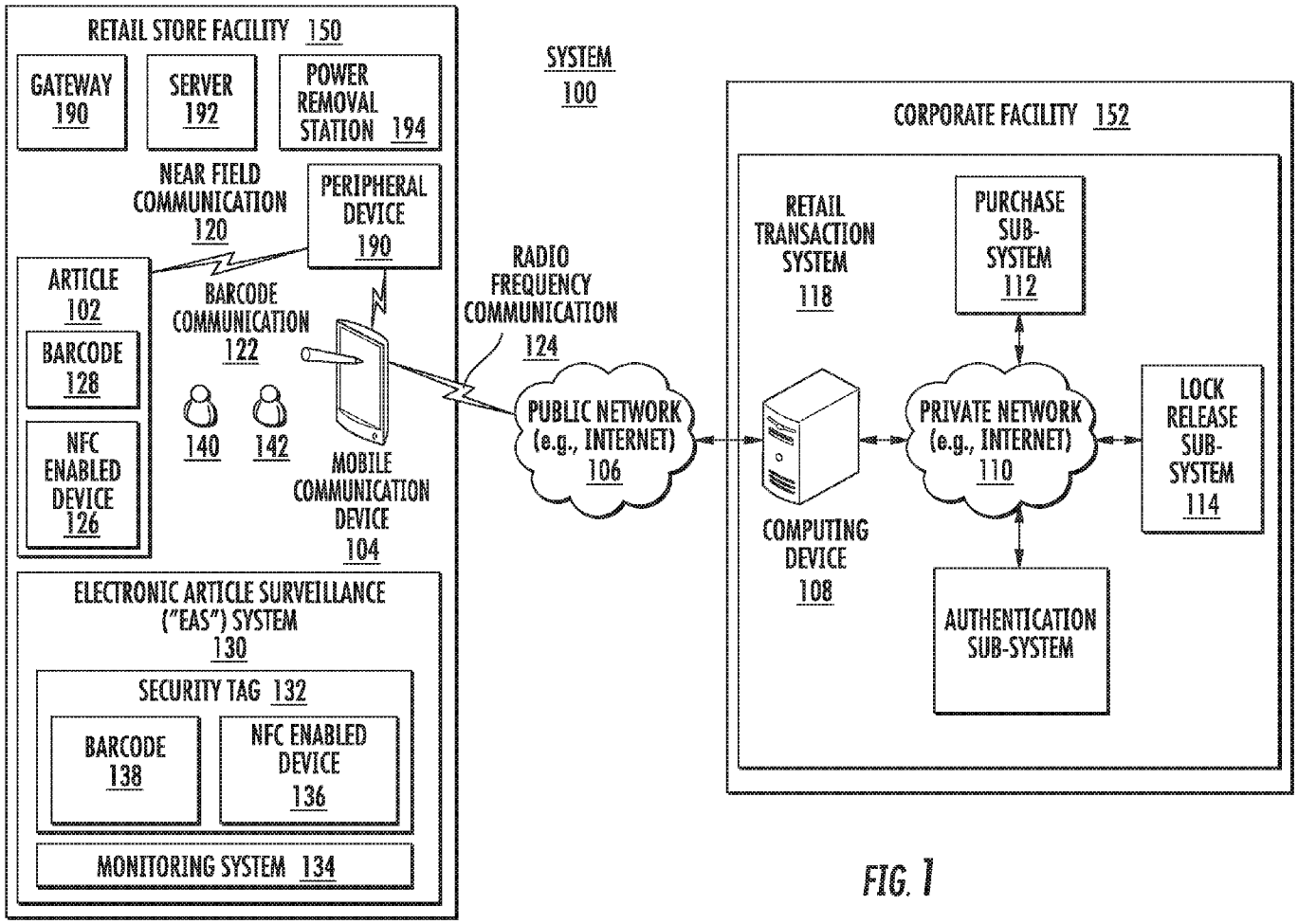
FIG. 1 is a schematic illustration of an exemplary system that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present disclosure concerns a self-detaching solution for security tags. The self-detaching solution allows a customer to select a desired item and make a secure payment of the desired item (e.g., using PayPal® or other cloud based online service). Once a purchase transaction has been verified by a retail store system, a wireless command signal is sent from the retail store system to a PRS for the security tag. In response to the wireless command signal, power is supplied from the PRS to the security tag such that a mechanical component (e.g., a solenoid, stepper motor or miniature actuator) thereof can be actuated. This actuation allows a removal of the security tag from the purchased item by the customer. For example, actuation of the mechanical component causes a captive pin to be released, whereby the security tag can be removed from the item. The captive pin is fixedly coupled to the security tag's housing such that there is no potential loss or theft thereof by the customer, or need to use two hands to couple/decouple the security tag from an item. This captive pin arrangement also ensures that the security tag is safe with no sharp object exposed to customers during their shopping experience or store personnel during their routine maintenance.

Notably, the self-detaching solution is compatible with existing Acousto-Magnetic ("AM") detection systems and RFID enabled inventory tracking systems. In some scenarios, an EAS Non-Deactivatable Label ("NDL") is disposed within the security tag. NDL's are well known in the art, and therefore will not be described herein. Any known or to be known NDL can be used herein without limitation. In some scenarios, the NDL is used to alert the customer and/or store personnel that the security tag is still attached to the article subsequent to deactivation thereof. This alert can occur prior to the customer's exiting of the store facility.

Also, a store associate and/or dedicated detacher unit is not required or needed for removing the security tag from the item. Dedicated detacher units are problematic for self-detaching applications. As such, a PRS is employed to facilitate the decoupling of security tags from articles, instead of dedicated detacher units. The PRS is generally configured to supply power to the security tag so that the mechanical component can be actuated subsequent to a successful purchase transaction. In some scenarios, the PRS also provides a signal including information (e.g., a known identifier of the PRS) that is authenticated or validated by the security tag prior to allowing the power to be supplied to the mechanical component. For example, a switch (disposed in the security tag) is closed when the information is authenticated or validated by the security tag. Closure of the switch provides a closed circuit between the mechanical component and the PRS power supply. The present invention is not limited to the particulars of this example. The PRS may be a fixed or mobile device. In the mobile scenarios, the PRS may be integrated with or coupled to a Mobile Point Of Sale ("MPOS") device.

Exemplary Systems for Customer Detachment of Security Tags

The present disclosure generally relates to systems and methods for operating a security tag of an EAS system. The methods involve: receiving a request to detach a security tag from an article; generating a signal including a command for actuating a detachment mechanism of a security tag; communicating the signal to a PRS for causing power to be supplied to the security tag; and supplying power to the security tag so as to cause actuation of a detachment mechanism contained therein. The detachment mechanism can include, but is not limited to, an electro-mechanical detachment mechanism. Operations of the electro-mechanical detachment mechanism will be described in detail below. The mechanical detachment portion of the electro-mechanical detachment mechanism may include, but is not limited to, a pin.

Referring now to FIG. 1, there is provided a schematic illustration of an exemplary system 100 that is useful for understanding the present invention. System 100 is generally configured to allow a customer to purchase an article 102 using a Mobile Communication Device ("MCD") 104 and an optional Peripheral Device ("PD") 190 thereof. PD 190 is designed to be mechanically attached to the MCD 104. In some scenarios, PD 190 wraps around at least a portion of MCD 104. Communications between MCD 104 and PD 190 are achieved using a wireless Short Rage Communication ("SRC") technology, such as a Bluetooth technology. PD 190 also employs other wireless SRC technologies to facilitate the purchase of article 102. The other wireless SRC technologies can include, but are not limited to, Near Field Communication ("NFC") technology, InfRared ("IR") technology, Wireless Fidelity ("Wi-Fi") technology, Radio Frequency Identification ("RFID") technology, and/or ZigBee technology. PD 190 may also employ barcode technology, electronic card reader technology, and Wireless Sensor Network ("WSN") communications technology.

As shown in FIG. 1, system 100 comprises a Retail Store Facility ("RSF") 150 including an EAS system 130. The EAS system 130 comprises a monitoring system 134 and at least one security tag 132. Although not shown in FIG. 1, the security tag 132 is attached to article 102, thereby protecting the article 102 from an unauthorized removal from the RSF 150. The monitoring system 134 establishes a surveillance zone (not shown) within which the presence of the security tag 132 can be detected. The surveillance zone is established at an access point (not shown) for the RSF 150. If the security tag 132 is carried into the surveillance zone, then an alarm is triggered to indicate a possible unauthorized removal of the article 102 from the RSF 150.

During store hours, a customer 140 may desire to purchase the article 102. The customer 140 can purchase the article 102 without using a traditional fixed POS station (e.g., a checkout counter). Instead, the purchase transaction can be achieved using MCD 104 and/or PD 190. MCD 104 (e.g., a mobile phone or tablet computer) can be in the possession of the customer 140 or store associate 142 at the time of the purchase transaction. Notably, MCD 104 has a retail transaction application installed thereon that is configured to facilitate the purchase of article 102 and the management/control of PD 190 operations for an attachment/detachment of the security tag 132 to/from article 102. The retail transaction application can be a pre-installed application, an add-on application or a plug-in application.

In order to initiate a purchase transaction, the retail transaction application is launched via a user-software interaction. The retail transaction application facilitates the exchange of data between the article 102, security tag 132, customer 140, store associate 142, and/or Retail Transaction System ("RTS") 118. For example, after the retail transaction application is launched, a user 140, 142 is prompted to start a retail transaction process for purchasing the article 102. The retail transaction process can be started simply by performing a user software interaction, such as depressing a key on a keypad of the MCD 104 or touching a button on a touch screen display of the MCD 104.

Subsequently, the user 140, 142 may manually input into the retail transaction application article information. Alternatively or additionally, the user 140, 142 places the MCD 104 in proximity of article 102. As a result of this placement, the MCD 104 and/or PD 190 obtains article information from the article 102. The article information includes any information that is useful for purchasing the article 102, such as an article identifier and an article purchase price. In some scenarios, the article information may even include an identifier of the security tag 132 attached thereto. The article information can be communicated from the article 102 to the MCD 104 and/or PD 190 via a Short Range Communication ("SRC"), such as a barcode communication 122 or an NFC 120. In the barcode scenario, article 102 has a barcode 128 attached to an exposed surface thereof. In the NFC scenarios, article 102 may comprise an NFC enabled device 126. If the PD 190 obtains the article information, then it forwards it to MCD 104 via a wireless SRC, such as a Bluetooth communication.

Thereafter, payment information is input into the retail transaction application of MCD 104 by the user 140, 142. Upon obtaining the payment information, the MCD 104 automatically performs operations for establishing a retail transaction session with the RTS 118. The retail transaction session can involve: communicating the article information and payment information from MCD 104 to the RTS 118 via an RF communication 124 and public network 106 (e.g., the Internet); completing a purchase transaction by the RTS 118; and communicating a response message from the RTS 118 to MCD 104 indicating that the article 102 has been successfully or unsuccessfully purchased. The purchase transaction can involve using an authorized payment system, such as a bank Automatic Clearing House ("ACH") payment system, a credit/debit card authorization system, or a third party system (e.g., PayPal®, SolidTrust Pay® or ApplePay®).

The purchase transaction can be completed by the RTS 118 using the article information and payment information. In this regard, such information may be received by a computing device 108 of the RTS 118 and forwarded thereby to a sub-system of a private network 110 (e.g., an Intranet). For example, the article information and purchase information can also be forwarded to and processed by a purchase sub-system 112 to complete a purchase transaction. When the purchase transaction is completed, a message is generated and sent to the MCD 104 indicating whether the article 102 has been successfully or unsuccessfully purchased.

If the article 102 has been successfully purchased, then a security tag detaching process can be started automatically by the RTS 118, the MCD 104 and/or the PRS 194. Alternatively, the user 140, 142 can start the security tag detaching process by performing a user-software interaction using the MCD 104 and/or the PRS 194. In all three scenarios, the article information can optionally be forwarded to and processed by a lock release sub-system 114 to retrieve a detachment key, a detachment code and/or a purchase token that is useful for detaching the security tag 132 from the article 102. The detachment key/code and/or purchase token is(are) then sent from the RTS 118 to the PRS 194 such that the PRS 194 can perform or cause the same to perform tag detachment operations. The tag detachment operations are generally configured to cause the security tag 132 to actuate a detaching mechanism (not shown in FIG. 1). In this regard, the PRS 194 supplies power to the security tag 132. The PRS 194 may also generate a detach command and sends a wireless detach signal including the detach command to the security tag 132. In this case, the security tag 132 authenticates the detach command and activates the detaching mechanism (e.g., by actuating a switch so that power is able to be supplied thereto). For example, the detach command causes a pin to be retracted such that the security tag can be removed from the article 102. Once the security tag 132 has been removed from article 102, the customer 140 can carry the article 102 through the surveillance zone without setting off the alarm.

Figure 2:
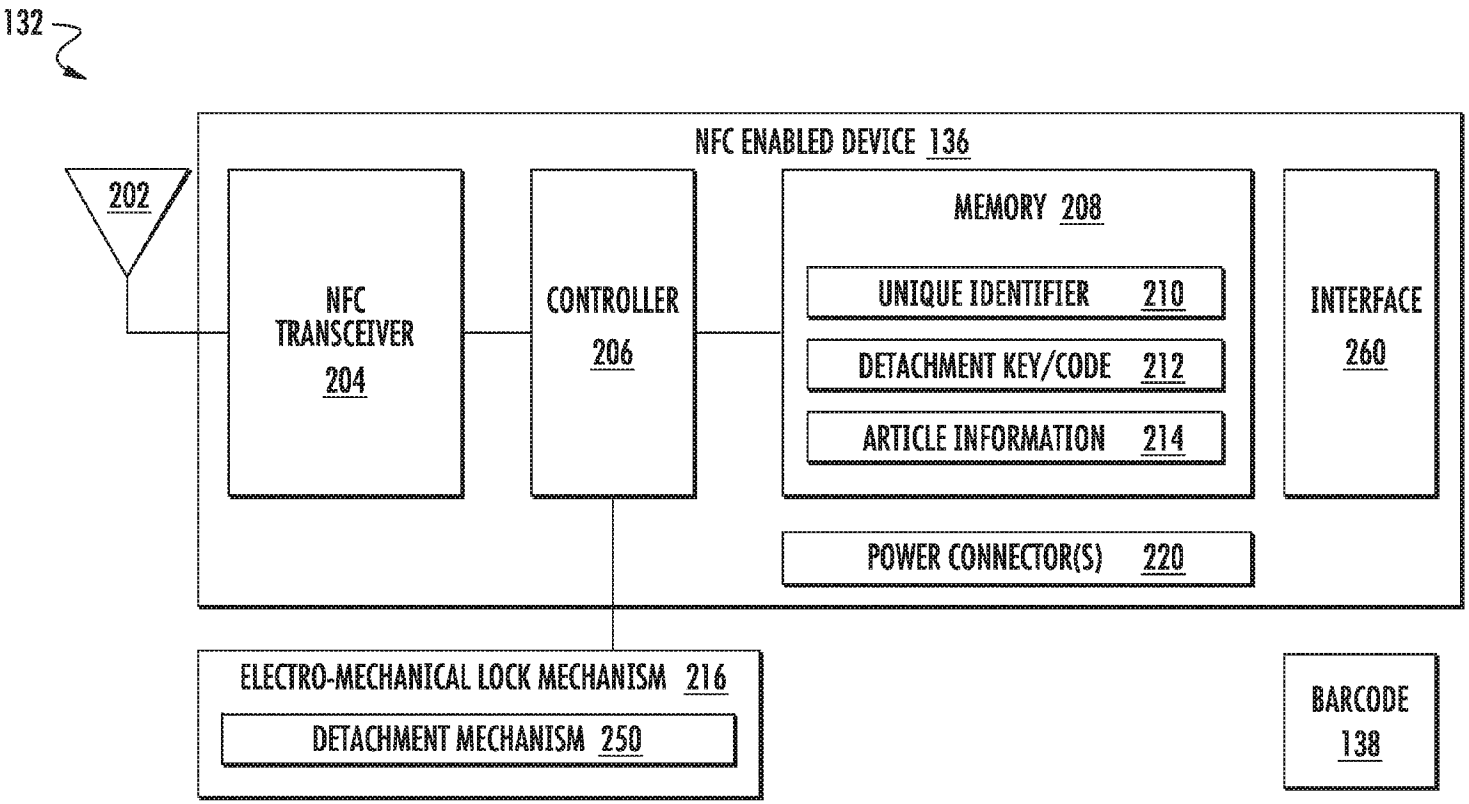
FIG. 2 is a block diagram of an exemplary architecture for a security tag shown in FIG. 1.

Referring now to FIG. 2, there is provided a schematic illustration of an exemplary architecture for security tag 132. Security tag 132 can include more or less components than that shown in FIG. 2. However, the components shown are sufficient to disclose an illustrative embodiment implementing the present invention. Some or all of the components of the security tag 132 can be implemented in hardware, software and/or a combination of hardware and software. The hardware includes, but is not limited to, one or more electronic circuits.

The hardware architecture of FIG. 2 represents an embodiment of a representative security tag 132 configured to facilitate the prevention of an unauthorized removal of an article (e.g., article 102 of FIG. 1) from a retail store facility (e.g., retail store facility 150 of FIG. 1). In this regard, the security tag 132 may have a barcode 138 affixed thereto for allowing data to be exchanged with an external device (e.g., PD 190 of FIG. 1) via barcode technology.

The security tag 132 also comprises an antenna 202 and an NFC enabled device 136 for allowing data to be exchanged with the external device via NFC technology. The antenna 202 is configured to receive NFC signals from the external device and transmit NFC signals generated by the NFC enabled device 136. The NFC enabled device 136 comprises an NFC transceiver 204. NFC transceivers are well known in the art, and therefore will not be described herein. However, it should be understood that the NFC transceiver 204 processes received NFC signals to extract information therein. This information can include, but is not limited to, a request for certain information (e.g., a unique identifier 210), and/or a message including information specifying a detachment key or code 212 for detaching the security tag 132 from an article. The NFC transceiver 204 may pass the extracted information to the controller 206.

If the extracted information includes a request for certain information, then the controller 206 may perform operations to retrieve a unique identifier 210 and/or article information 214 from memory 208. The article information 214 can include a unique identifier of an article and/or a purchase price of the article. The retrieved information is then sent from the security tag 132 to a requesting external device (e.g., PD 190 of FIG. 1) via an NFC communication.

In contrast, if the extracted information includes information specifying a one-time-only use key and/or instructions for programming the security tag 132 to actuate a detachment mechanism 250 of an electro-mechanical lock mechanism 216, then the controller 206 may perform operations to simply actuate the detachment mechanism 250 using the one-time-only key. Alternatively or additionally, the controller 206 can: parse the information from a received message; retrieve a detachment key/code 212 from memory 208; and compare the parsed information to the detachment key/code to determine if a match exists therebetween. If a match exists, then the controller 206 generates and sends a command to the electro-mechanical lock mechanism 216 for actuating the detachment mechanism 250. An auditory or visual indication can be output by the security tag 132 when the detachment mechanism 250 is actuated. If a match does not exist, then the controller 206 may generate a response message indicating that detachment key/code specified in the extracted information does not match the detachment key/code 212 stored in memory 208. The response message may then be sent from the security tag 132 to a requesting external device (e.g., PD 190 of FIG. 1) via a wireless short-range communication or a wired communication via interface 260. A message may also be communicated to another external device or network node via interface 260.

In some scenarios, the connections between components 204, 206, 208, 216, 260 are unsecure connections or secure connections. The phrase "unsecure connection", as used herein, refers to a connection in which cryptography and/or tamper-proof measures are not employed. The phrase "secure connection", as used herein, refers to a connection in which cryptography and/or tamper-proof measures are employed. Such tamper-proof measures include enclosing the physical electrical link between two components in a tamper-proof enclosure.

Notably, the memory 208 may be a volatile memory and/or a non-volatile memory. For example, the memory 208 can include, but is not limited to, a Random Access Memory ("RAM"), a Dynamic Random Access Memory ("DRAM"), a Static Random Access Memory ("SRAM"), a Read-Only Memory ("ROM") and a flash memory. The memory 208 may also comprise unsecure memory and/or secure memory. The phrase "unsecure memory", as used herein, refers to memory configured to store data in a plain text form. The phrase "secure memory", as used herein, refers to memory configured to store data in an encrypted form and/or memory having or being disposed in a secure or tamper-proof enclosure.

The electro-mechanical lock mechanism 216 is operable to actuate the detachment mechanism 250. The detachment mechanism 250 can include a lock configured to move between a lock state and an unlock state. Such a lock can include, but is not limited to, a pin. The electro-mechanical lock mechanism 216 is shown as being indirectly coupled to NFC transceiver 204 via controller 206. The invention is not limited in this regard. The electro-mechanical lock mechanism 216 can additionally or alternatively be directly coupled to the NFC transceiver 204. One or more of the components 204, 206 can cause the lock of the detachment mechanism 250 to be transitioned between states in accordance with information received from an external device (e.g., PRS 194 of FIG. 1). The components 204-208, 260 may be collectively referred to herein as the NFC enabled device 136.

The NFC enabled device 136 can be incorporated into a device which also houses the electro-mechanical lock mechanism 216, or can be a separate device which is in direct or indirect communication with the electro-mechanical lock mechanism 216. Notably, the NFC enabled device 136 is not coupled to an internal power source. Instead, an external power source is provided by the PRS 194 of FIG. 1. In this regard, NFC enabled device 136 comprises a power connector(s) 220. Alternatively or additionally, the NFC enabled device 136 is configured as a passive device which derives power from an RF signal inductively coupled thereto.

Exemplary Security Tag Architectures

Exemplary architectures for a security tag 300 will now be described in detail in relation to FIGS. 3-9. Security tag 132 is the same as or similar to security tag 300. As such, the following discussion of security tag 300 is sufficient for understanding various features of security tag 132.

As shown in FIGS. 3-6 and 8-9, the security tag 300 comprises a hard EAS tag. The hard EAS tag may be formed of a molded plastic enclosure (which is not shown in FIGS. 3-6 and 8-9). An EAS and/or RFID element (not shown in FIGS. 3-6 and 8-9) may be housed within the molded plastic enclosure. The molded plastic enclosure may be defined by first and second housing portions (not shown in FIGS. 3-6 and 8-9) that are securely coupled to each other (e.g., via an adhesive, an ultrasonic weld and/or mechanical couplers such as screws).

The security tag has an insert space 302 sized and shaped for receiving at least a portion of an article (e.g., article 102 of FIG. 1) so that the security tag 300 can be securely attached or coupled thereto. Insert space 302 is also sized and shaped to prevent injury to users. In this regard, insert space 302 is designed so that at least an adult finger is unable to be inserted therein.

Figure 3:
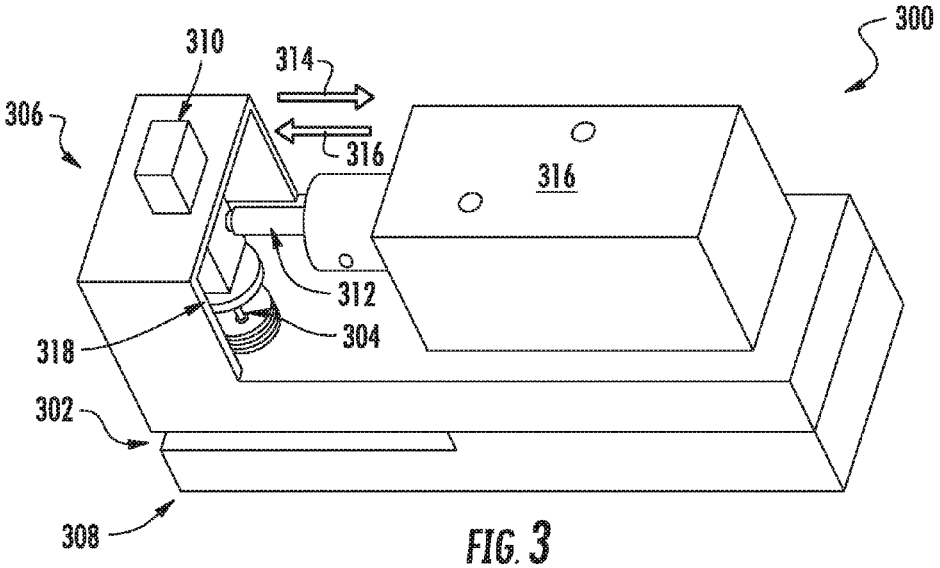
FIG. 3 is a top perspective view of an exemplary security tag in an unlocked position.
Figure 4:
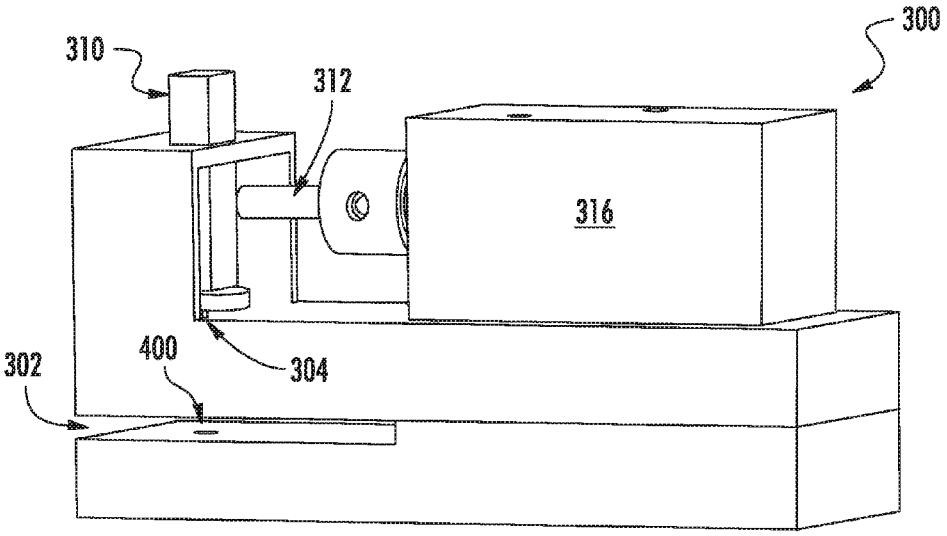
FIG. 4 is a side perspective view of the security tag shown in FIG. 3.
Figure 5:
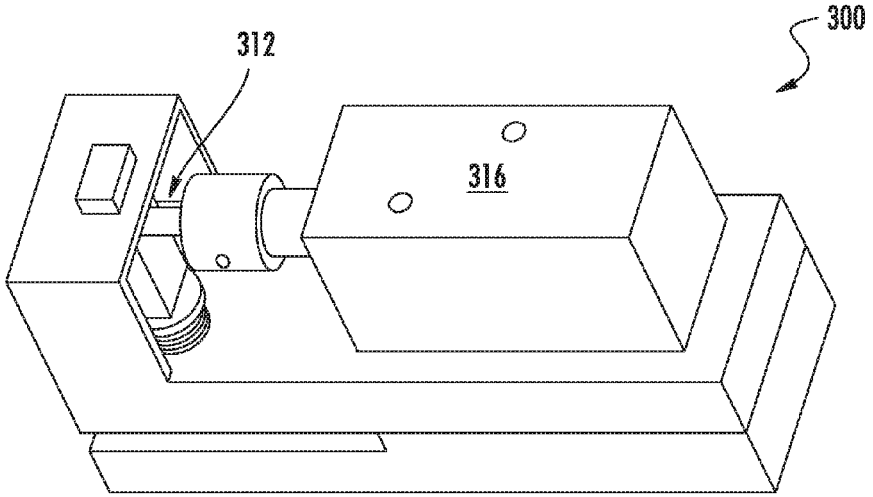
FIG. 5 is a top view of the security tag shown in FIGS. 3-4 in a locked position.
Figure 6:
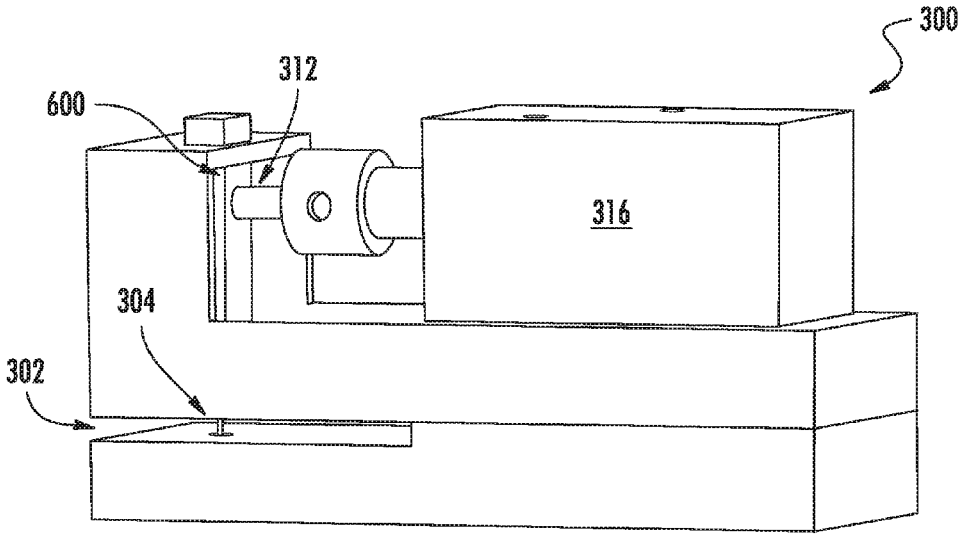
FIG. 6 is a side view of the security tag shown in FIGS. 3-5.

The security tag 300 is securely coupled to the article by transitioning a pin 304 from an unengaged state shown in FIGS. 3-4 to an engaged state shown in FIGS. 5-6. The transitioning is achieved by moving the pin 304 out of a first section 306 of the security tag 300, through the insert space 302, and into an aperture 400 formed in a second section 308 of the security tag 300. An actuator (e.g., plunger) 310 is provided to allow a user to control said transitioning. The actuator may be accessible via a top surface of the security tag 300 as shown in FIGS. 3-6 or alternatively on another surface (e.g., a side surface) of the enclosure. Notably, in some scenarios, the pin 304 entirely resides within the first section 306 when it is in its unengaged position so that the pin 304 cannot cause injury to a user.

A mechanical mechanism 312 retains the pin 304 in its engaged state. The mechanical mechanism 312 comprises a post that is movable in two opposing directions shown by arrows 314, 316. When the post 312 is in its engaged state shown in FIGS. 5-6, it is at least partially inserted into an aperture 600 formed in the actuator 310. In contrast, when the post 312 is in its unengaged state shown in FIGS. 3-4, it does not engage the actuator 310 so that the actuator can freely return to its unengaged state. A resilient member (e.g., a spring) 318 is provided to facilitate a hands-free transition of the actuator 310 from its engaged state to its unengaged state.

An electric solenoid 316 is provided to facilitate selective movement of the post 312 in both directions 314 and 316. Notably, the electric solenoid 316 and mechanical mechanism 312 comprises an electro-mechanical lock mechanism (e.g., electro-mechanical lock mechanism 216 of FIG. 2). The electro-mechanical lock mechanism is not limited to these components. For example, the electric solenoid 316 may be replaced with a gear motor. Electric solenoids and gear motors are well known in the art, and therefore will not be described herein. Any known or to be known electric solenoid and/or gear motor can be used herein without limitation, provided that the overall size thereof complies with the size requirements of the security tag 300.

Figure 7:
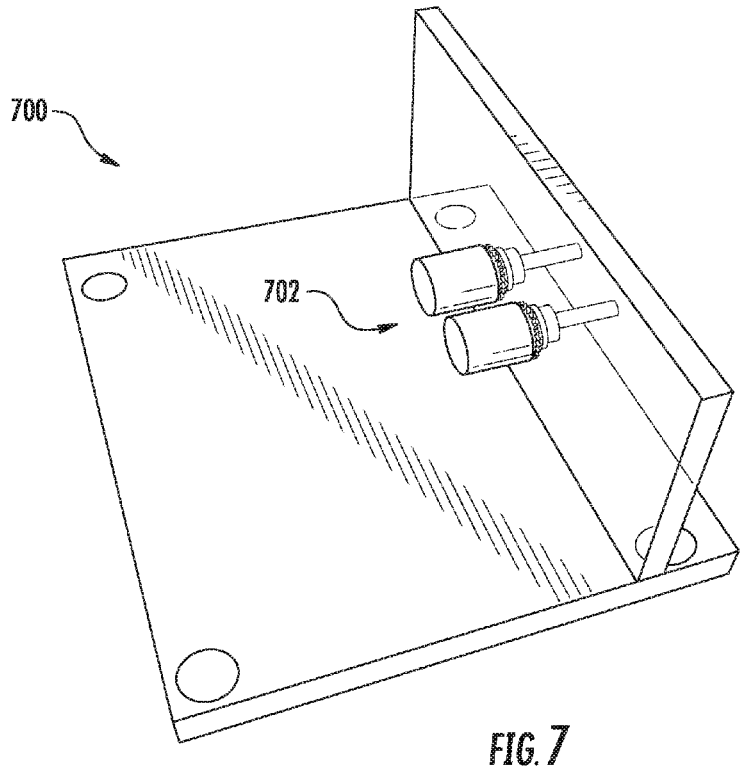
FIG. 7 is a top perspective view of a power removal station for the security tag shown in FIGS. 3-6.
Figure 8:
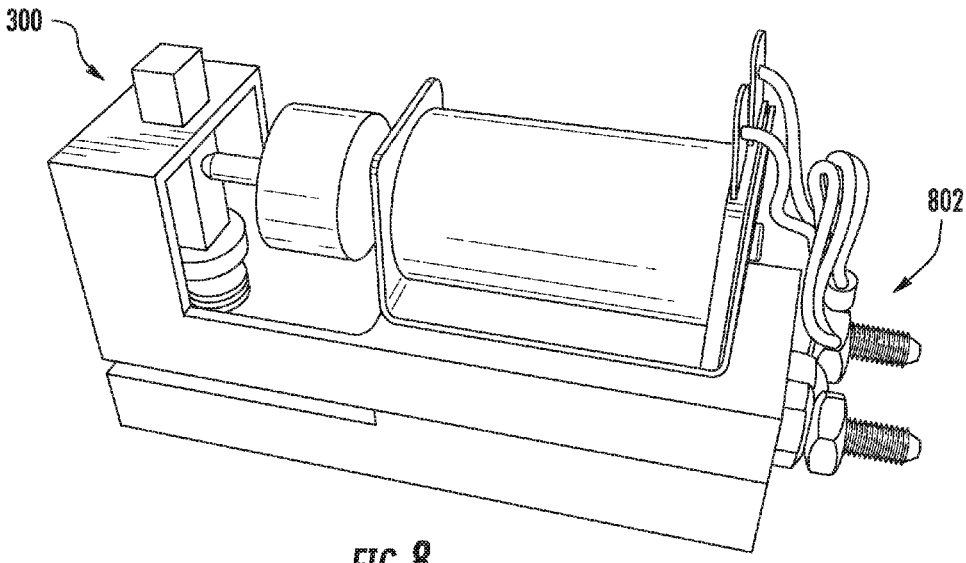
FIG. 8 is a perspective view of the security tag shown in FIGS. 3-6 with power connectors for engaging the power removal station of FIG. 7.
Figure 9:
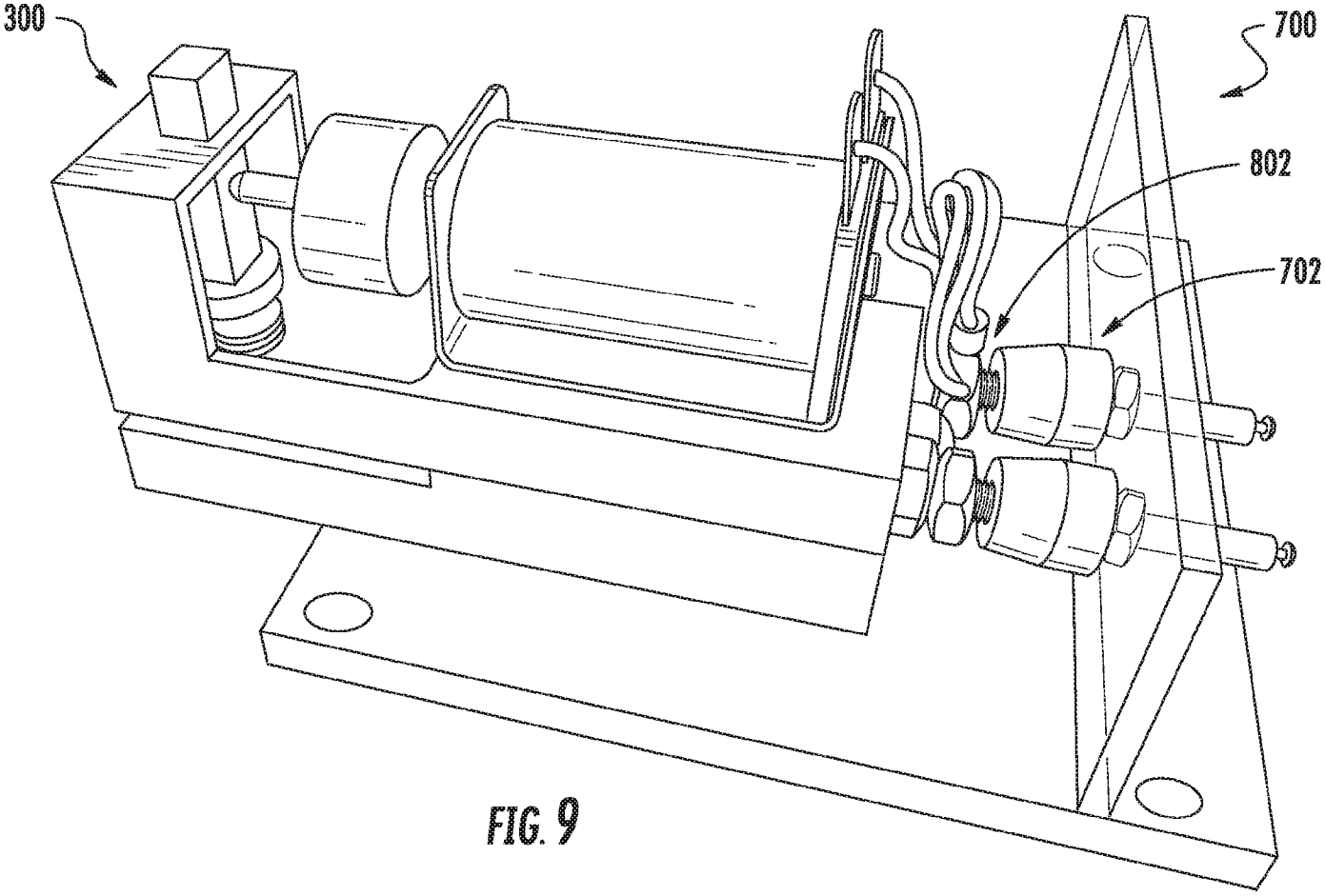
FIG. 9 is a schematic illustration showing the security tag of FIG. 8 disposed on and electrically coupled to the power removal station of FIG. 7.

Referring now to FIGS. 7-9, there are provided schematic illustrations that are useful for understanding how power is supplied to a security tag 300 via a PRS 700. PRS 194 of FIG. 1 is the same as or similar to PRS 700. As such, the discussion of PRS 700 is sufficient for understanding PRS 194. PRS 700 can include more or less components then that shown in FIG. 7. The PRS may be a fixed or mobile device. In the mobile scenarios, the PRS may be integrated with or coupled to an MPOS device.

PRS 700 is generally configured to supply power to the security tag (e.g., security tag 132 of FIG. 1 and/or security tag 300 of FIGS. 3-6) when a successful purchase transaction has occurred so that the security tag can be removed from the item to which it is coupled. In this regard, PRS 700 includes an electronic circuit (not shown) operative to verify that a successful purchase transaction has occurred for the item to which the security tag is coupled. Upon such verification, PRS 700 can perform tag detachment operations.

The tag detachment operations are generally configured to cause the security tag to actuate a detaching mechanism (e.g., solenoid 316 of FIGS. 3-6). In this regard, the PRS 700 supplies power to the security tag via power connectors 702, 802. The PRS 700 may also generate a detach command and send a detach signal including the detach command to the security tag. In this case, the security tag authenticates the detach command and activates the detaching mechanism. For example, the detach command causes a pin (e.g., pin 304 of FIG. 3-6) to be retracted such that the security tag can be removed from the article. Once the security tag has been removed from the article, the customer can carry the article through the surveillance zone without setting off the alarm.

Exemplary Methods for Operating a Security Tag

Figure 10:
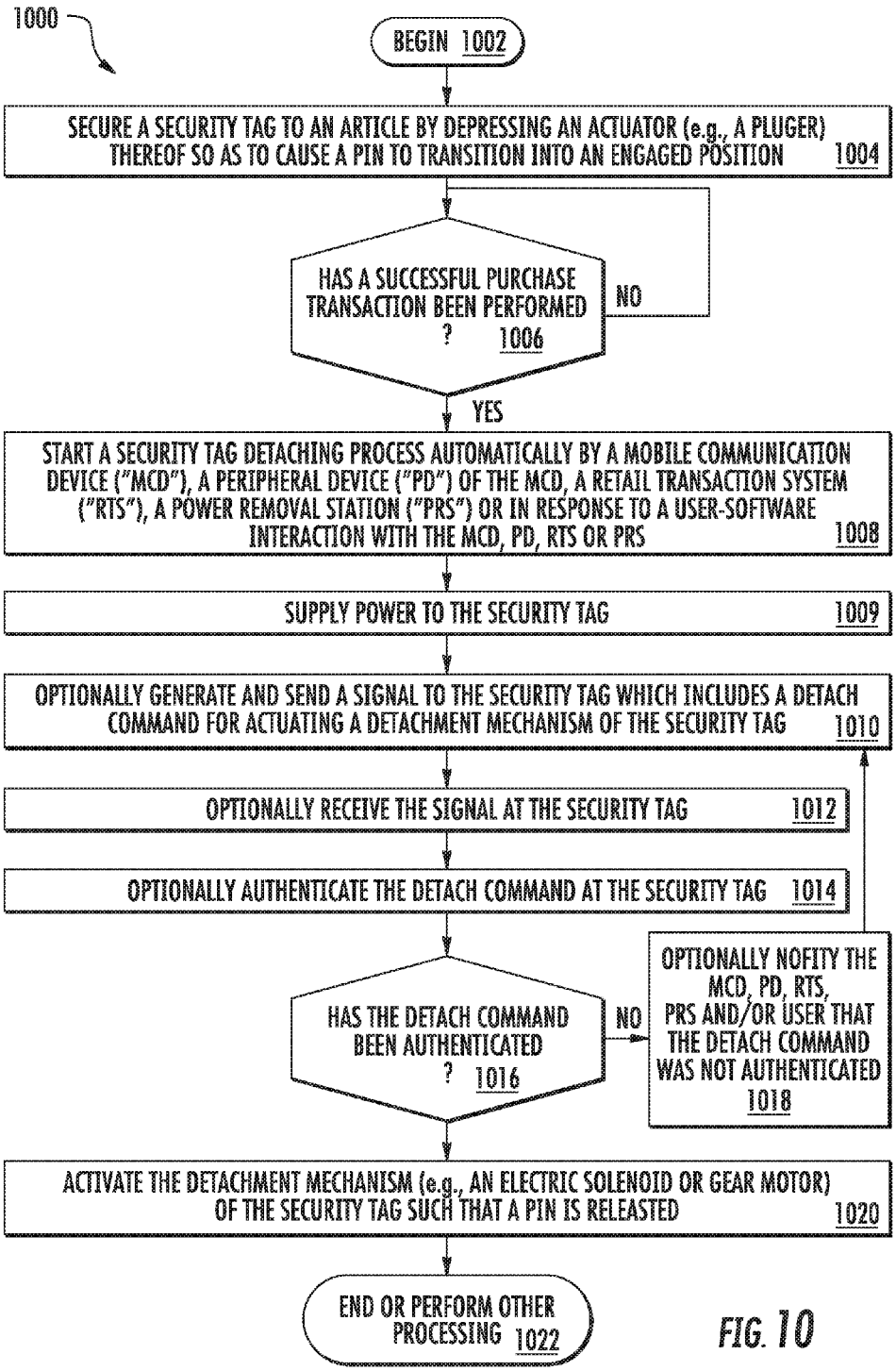
FIG. 10 is a flow chart of an exemplary method for operating a security tag.

Referring now to FIG. 10, there is provided a flow diagram of an exemplary method 1000 for operating a security tag. Method 1000 begins with step 1002 and continues with step 1004 where a security tag (e.g., security tag 132 of FIG. 1 or 300 of FIGS. 3-6) is attached to an article (e.g., article 102 of FIG. 1). This step involves depressing an actuator (e.g., actuator 310 of FIG. 3) of the security tag so as to cause a pin (e.g., pin 304 of FIG. 3) to transition into an engaged position (shown in FIGS. 5-6). The manner in which the pin transitions to its engaged position is described above in relation to FIGS. 3-4.

Sometime thereafter, a decision step 1006 is performed to determine if a purchase transaction has been successfully performed. If the purchase transaction was not successful [1006:NO], then method 1000 repeats step 1006. In contrast, if the purchase transaction was successful [1006:YES], then step 1008 is performed where a security tag detaching process is automatically begun by an MCD (e.g., MCD 104 of FIG. 1), a PD (e.g., PD 190 of FIG. 1), an RTS (e.g., RTS 118 of FIG. 1), an PRS (e.g., PRS 194 of FIG. 1) or in response to a user-software interaction with the MCD, PD, RTS or PRS. The security tag detaching process involves the operations performed in steps 1009-1020. These steps involve: supplying power to the security tag; optionally generating and sending a signal to the security tag which includes a detach command for actuating a detachment mechanism of the security tag; optionally receiving the signal at the security tag; and optionally authenticating the detach command at the security tag.

If the detach command is not authenticated [1016:NO], then optional step 1018 is performed where the MCD, PD, RTS, PRS and/or user is(are) notified that the detach command was not authenticated by the security tag. Subsequently, method 1000 returns to step 1010.

If step 1009 is completed and/or the detach command is authenticated [1016:YES], then a detachment mechanism (e.g., electric solenoid 316 of FIG. 3) of the security tag is activated as shown by step 1020. Such activation can be achieved simply by supplying power to the detachment mechanism so that a pin (e.g., pin 304 of FIG. 3) is released. The pin's release can be achieved in the manner described above in relation to FIGS. 3-6. Subsequent to completing step 1020, step 1022 is performed where method 1000 ends or other processing is performed.

Referring now to FIG. 11, there is provided a flow chart of another exemplary method 1100 for operating a security tag (e.g., security tag 132 of FIG. 1 or 300 of FIG. 3). Method 1100 begins with step 1102. Although not shown in FIG. 11, it should be understood that user authentication operations and/or function enablement operations may be performed prior to step 1102. For example, a user of an MCD (e.g., MCD 104 of FIG. 1) may be authenticated, and therefore one or more retail-transaction operations of the MCD may be enabled based on the clearance level of the user and/or the location to the MCD within a retail store facility (e.g., retail store facility 150 of FIG. 1). The location of the MCD can be determined using GPS information. In some scenarios, a "heart beat" signal may be used to enable the retail-transaction operation(s) of the MCD and/or PD (e.g., PD 190 of FIG. 1). The "heart beat" signal may be communicated directly to the MCD or indirectly to the MCD via the PD.

After step 1102, method 1100 continues with step 1104 where a customer (e.g., customer 140 of FIG. 1) enters the retail store facility and accumulates one or more articles (e.g., article 102 of FIG. 1) to purchase. In some scenarios, the customer may then ask a store associate (e.g., store associate 142 of FIG. 1) to assist in the purchase of the accumulated articles. This may be performed when the customer does not have an MCD (e.g., MCD 104 of FIG. 1) with a retail transaction application installed thereon and/or a PD (e.g., peripheral device 190 of FIG. 1) coupled thereto. If the customer is in possession of such an MCD, then the customer would not need the assistance from a store associate for completing a purchase transaction and/or detaching security tags from the articles, as shown by steps 1106-1114.

In next step 1106, the customer performs user-software interactions with the MCD and/or PD so as to cause a retail transaction application installed on the MCD to be executed. The customer then uses the MCD and/or PD to scan each article for tendering, as shown by step 1108. The scanning can be achieved using a barcode scanner, an RFID scanner, an NFC tag scanner, or any other short-range communication means of the MCD and/or PD. Alternatively or additionally, the customer may enter voice commands in order to confirm each article (s)he desires to purchase.

Once the articles have been scanned, payment information is input into the retail transaction application of the MCD, as shown by step 1110. The payment information can include, but is not limited to, a customer loyalty code, payment card information, and/or payment account information. The payment information can be input manually using an input device of MCD or PD, via an electronic card reader (e.g., a magnetic strip card reader) of MCD or PD, and/or via a barcode reader of the MCD or PD.

After the payment information has been input into the retail transaction application, a decision step 1112 is performed to determine if a purchase transaction has been completed. The purchase transaction can be completed using a web-based payment service (e.g., using PayPal®, Apple-Pay® or other cloud based online service). The determination of step 1112 is made by the web-based payment service system based on information received from the MCD and/or an RTS (e.g., RTS 118 of FIG. 1). If the purchase transaction is not completed [1112:NO], then method 1100 repeats step 1112. If the purchase transaction is completed [1112:YES], then method 1100 continues with step 1114.

In step 1114, the web-based payment service system generates and sends a purchase token to the MCD. The purchase token may also be communicated from the web-based payment service system and/or MCD to each security tag attached to a purchased item. The purchase token stored in a memory device of a security tag can be used later to (1) assist in determining why a failure occurred in relation to the security tag's detachment from the article and/or (2) whether a recently found security tag was removed from a purchased item or a stolen item. The manner in which (1) and (2) are resolved will be discussed below in detail.

Upon completing step 1114, the MCD communicates the purchase token and unique identifiers of each purchased product from the MCD to a server (e.g., server 108 of FIG. 1) located at a corporate facility (e.g., corporate facility 152 of FIG. 1) via secure communications link, as shown by step 1116. In a next step 1118, the server performs operations to verify the purchase token using the web-based payment service. If the purchase token is not verified [1120:NO], then method 1100 returns to step 1110. If the purchase token is verified [1120:YES], then method 1100 continues with step 1122 of FIG. 11B.

Figure 11A:
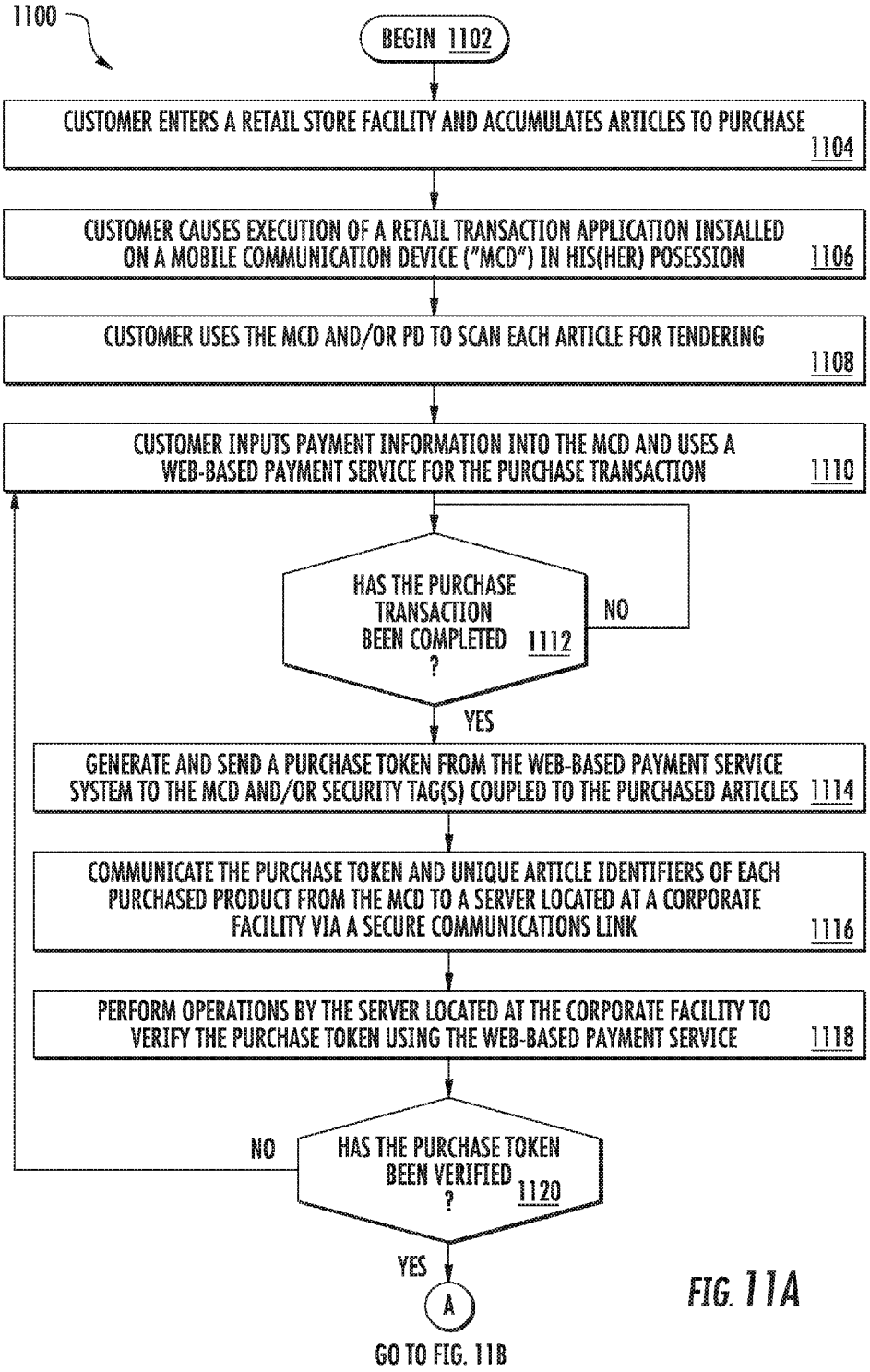
FIGS. 11A-11D (collectively referred to herein as "FIG. 11") provide a flow chart of another exemplary method for operating a security tag.
Figure 11B:
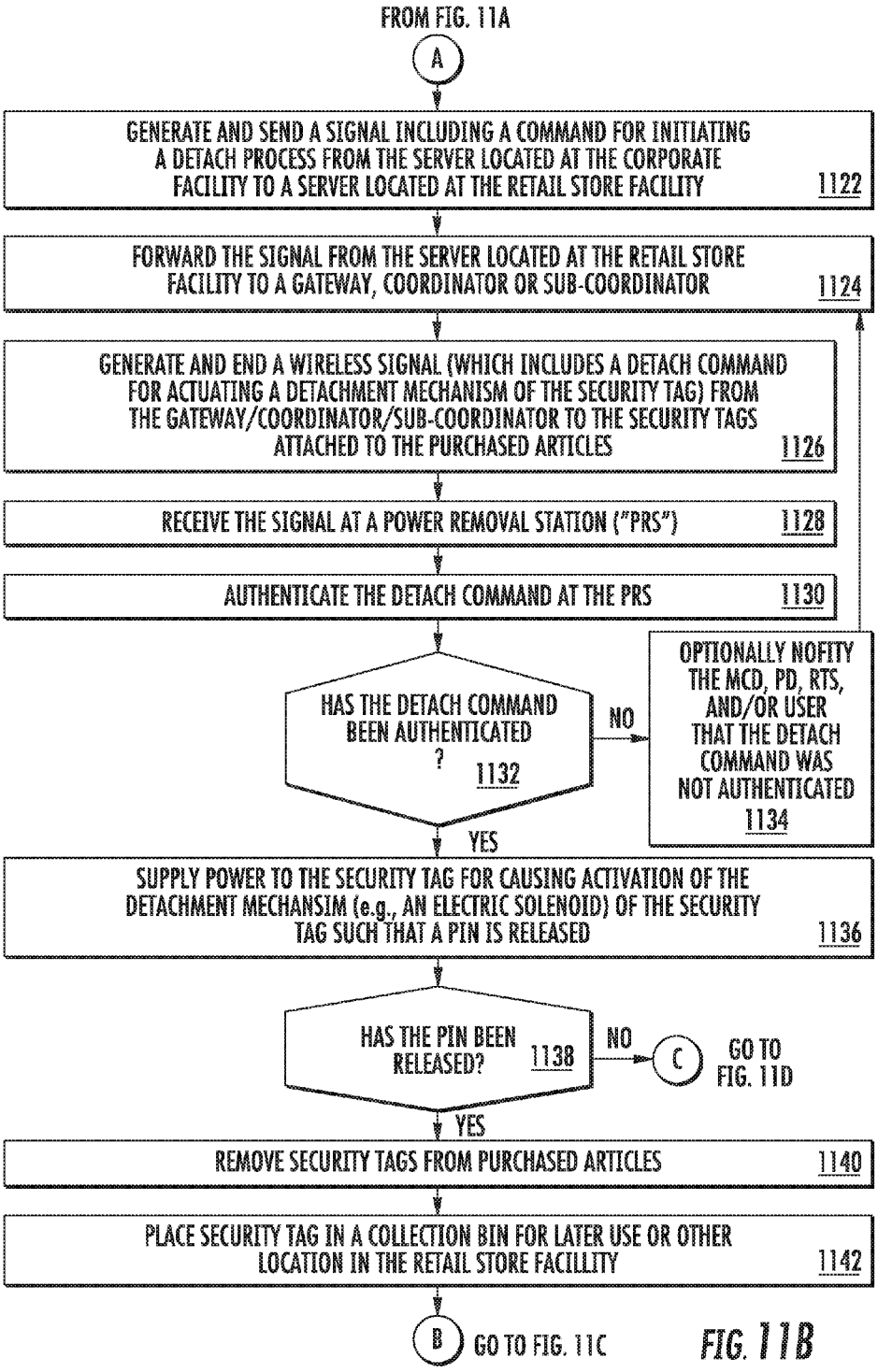
Figure 11C:
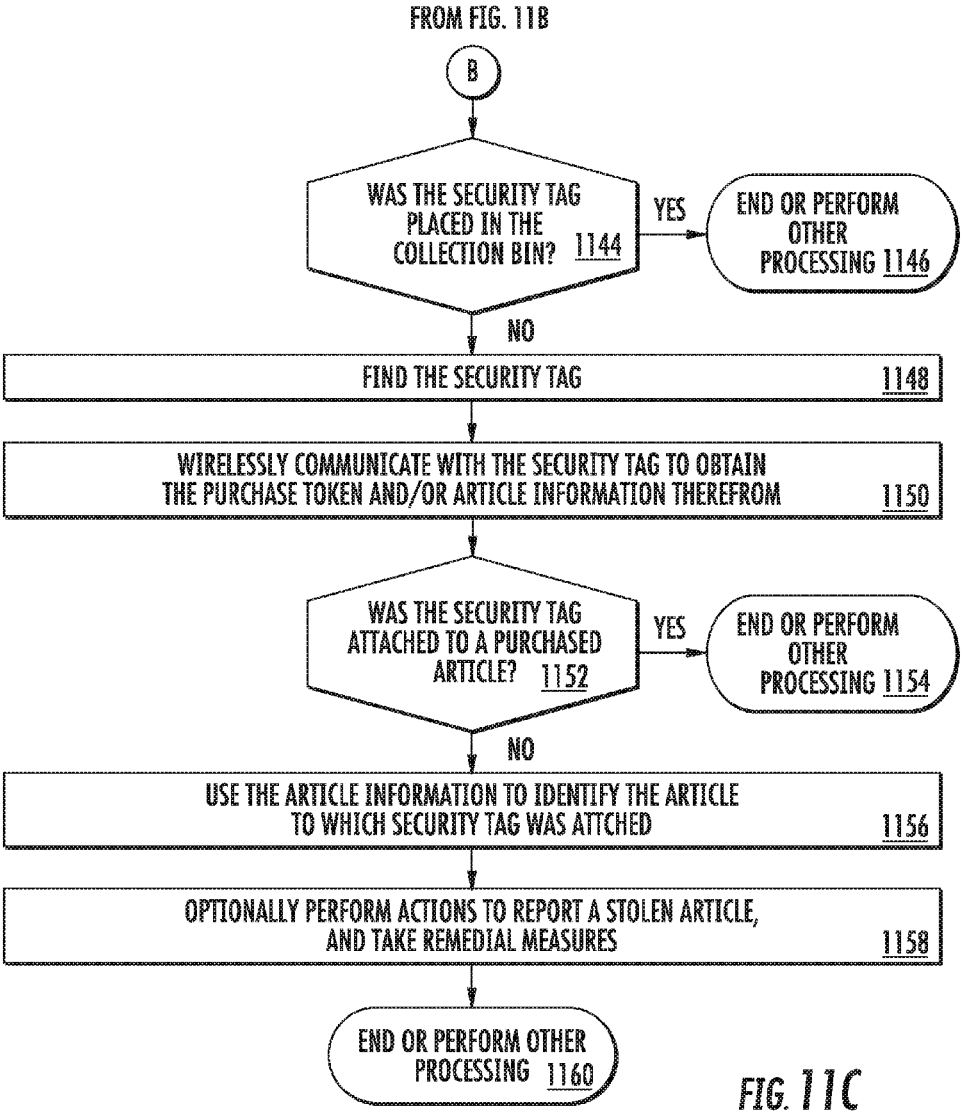

As shown in FIG. 11B, step 1122 involves generating and sending a signal from the server located in the corporate facility to a server (e.g., server 192 of FIG. 1) located in a retail store facility (e.g., retail store facility 150 of FIG. 1). The signal includes a command for initiating a detach process. This signal is forwarded to a gateway (e.g., gateway 190 of FIG. 1), coordinator or sub-coordinator, as shown by step 1124. At the gateway/coordinator/sub-coordinator, a wireless signal is generated which includes a detach command for actuating a detachment mechanism of the security tag(s) attached to the purchases article(s), as shown by step 1126. The wireless signal is then sent to the PRS (e.g., PRS 194 of FIG. 1).

After reception of the wireless signal in step 1128, the PRS authenticates the detach command as shown by step 1130. If the detach command is not authenticated [1132: NO], then optional step 1134 is performed where the MCD, PD, RTS and/or user is(are) notified that the detach command was not authenticated by the PRS. Subsequently, method 1100 returns to step 1126. If the detach command is authenticated [1132:YES], then the PRS supplies power to the security tag for activating a detachment mechanism (e.g., electric solenoid 316 of FIG. 3) thereof. Such activation can be achieved simply by supplying power to the detachment mechanism so that a pin (e.g., pin 304 of FIG. 3) is released. The pin's release can be achieved in the manner described above in relation to FIGS. 3-6.

Next, a decision step 1138 is performed to determine if the pin was actually released. If the pin was actually released [1138:YES], then method 1100 continues with step 1140. In step 1140, the security tag is removed from the article that has been successfully purchased. The removed security tag may be placed in a collection bin for later use or other location in the retail store facility (e.g., a dressing room), as shown by step 1142. Subsequently, method 1100 continues with a decision step 1144 of FIG. 11C in which a determination is made as to whether or not the security tag was placed in the collection bin.

If the security tag was placed in the collection bin [1144:YES], then step 1146 is performed where method 1100 ends or other processing is performed. In contrast, if the security tag was not placed in the collection bin [1144: NO], then steps 1148-1150 are performed. These steps involve: finding the security tag (e.g., in a dressing room); and wirelessly communicating with the security tag to obtain the purchase token and/or article information therefrom. The purchase token and/or article information is then used to determine whether the security tag was attached to a purchased article. If the security tag was attached to a purchased item [1152:YES], then step 1154 is performed where method 1100 ends or other processing is performed. If the security tag was not attached to a purchased item [1152:NO], then steps 1156-1158 are performed. These steps involve: using the article information to identify the article to which the security tag was attached; optionally performing actions to report a stolen article; and optionally taking remedial measures. Subsequently, step 1160 is performed where method 1100 ends or other processing is performed.

Figure 11D:
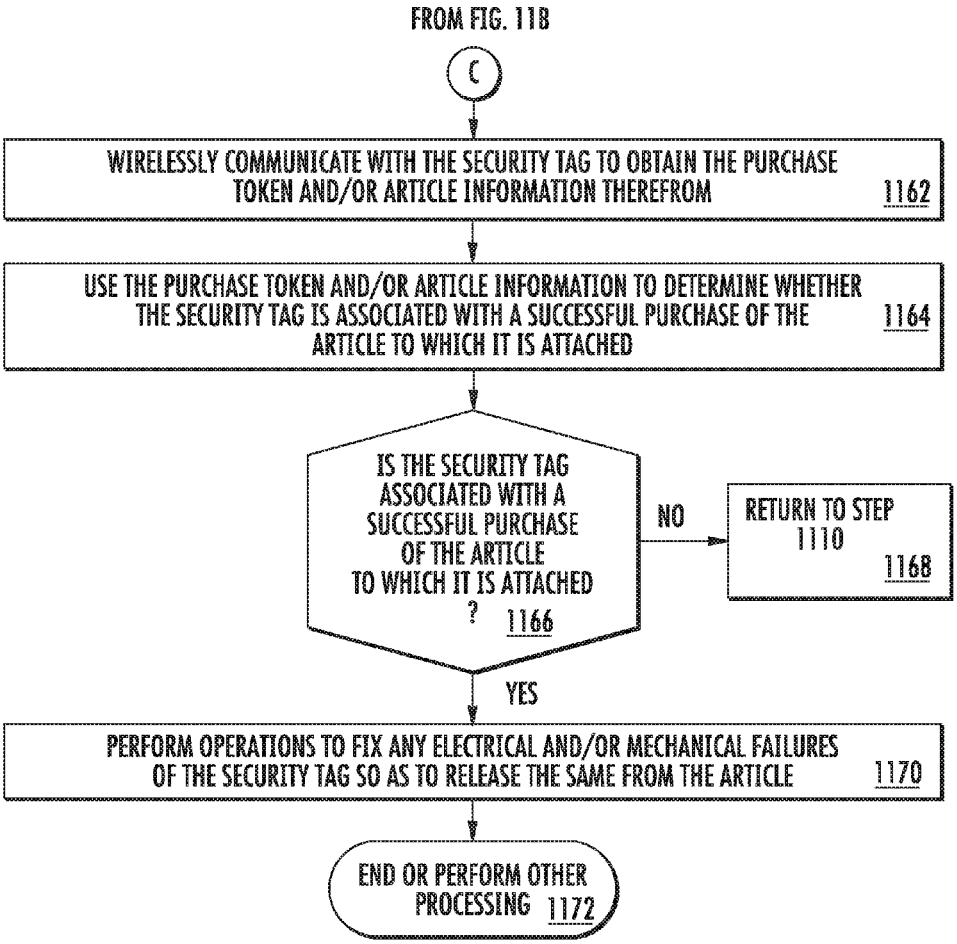

In contrast, if the pin was not released [1138:NO], then method 1100 continues with steps 1162-1170 of FIG. 11D. These steps involve: wirelessly communicating with the security tag to obtain the purchase token and/or article information therefrom; and using the purchase token and/or article information to determine whether the security tag is associated with a successful purchase of the article to which it is attached. If the security tag is not associated with a successful purchase of the article to which it is attached [1166:NO], then step 1168 is performed where method 1000 returns to step 1110 so that the purchase transaction is re-performed in relation to this particular article. If the security tag is associated with a successful purchase of the article to which it is attached [1166:YES], then operations are performed to fix any electrical and/or mechanical failures of the security tag so as to release the same from the article, as shown by step 1170. Subsequently, step 1172 is performed where method 1100 ends or other processing is performed.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A method for operating a security tag, comprising:

establishing a direct electrical connection between power connectors of the security tag and power connectors of an external Power Removal Station ("PRS");

receiving, by the security tag, a wireless detach command from the PRS;

performing operations by the security tag to authenticate the received wireless detach command;

selectively actuating a switch disposed in the security tag to provide a closed circuit between an electro-mechanical component of the security tag and the external PRS, when the received wireless detach command is authenticated;

receiving power supplied from the external PRS at the electro-mechanical component of the security tag, subsequent to when the switch is selectively actuated; and actuating the electro-mechanical component so that a pin of the security tag transitions from a fully engaged position to a fully unengaged position without any human assistance or mechanical assistance by a device external to the security tag, where the pin is fixedly coupled to the security tag's housing.

2. The method according to claim 1, wherein the wireless detach command is sent from the external PRS to the security tag when a verification has been made that an article to which the security tag is attached has been successfully purchased.

3. The method according to claim 1, wherein an end of the pin resides within an aperture formed in a first portion of the security tag at least partially spaced apart from a second portion of the security tag by a gap when the pin is in the engaged position.

4. The method according to claim 3, wherein the pin is fully retracted into the second portion of the security tag when the pin is in the unengaged position.

5. The method according to claim 3, wherein the gap is sized and shaped to prevent a user's access to the pin while the security tag is being coupled to the article at least partially inserted into the gap.

6. The method according to claim 1, wherein the pin is fixedly coupled to the security tag's housing.

7. The method according to claim 1, wherein the electro-mechanical component is a solenoid or a motor.

8. A method for operating a security tag, comprising:

establishing a direct electrical connection between power connectors of a Power Removal Station ("PRS") and power connectors of the security tag;

receiving by the PRS a signal sent from a computing device when a verification has been made that an article to which the security tag is attached has been successfully purchased;

transmitting a wireless detach command from the PRS to the security tag to cause a switch internal to the security tag to be selectively actuated so that a closed circuit is provided between the PRS and an electro-mechanical component of the security tag; and supplying power from the PRS to the electro-mechanical component of the security tag subsequent to when the switch is selectively actuated so as to enable actuation of a mechanical component of the security tag, whereby a pin of the security tag transitions from a engaged position to a unengaged position without any human assistance or mechanical assistance by a device external to the security tag.

9. The method according to claim 8, wherein the mechanical component is actuated upon authentication of the wireless detach command sent from the PRS and received at the security tag.

10. A security tag, comprising:

an electro-mechanical component;

an electrical connector coupled to the electro-mechanical component and configured to establish an electrical connection between the security tag and an external Power Removal Station ("PRS"); and an electrical circuit configured to authenticate a wireless detach command sent from the external PRS, cause an internal switch to be selectively actuated so that a closed circuit is provided between the electro-mechanical component and the external PRS, when the wireless detach command is authenticated, allow power to be supplied from the external PRS to the electro-mechanical component, subsequent to when the internal switch is selectively actuated, and cause actuation of the electro-mechanical component so that a pin of the security tag transitions from an engaged position to an unengaged position without any human assistance or mechanical assistance by a device external to the security tag.

11. The security tag according to claim 10, wherein the wireless detach command is sent from the external PRS to the security tag when a verification has been made that an article to which the security tag is attached has been successfully purchased.

12. The security tag according to claim 10, wherein an end of the pin resides within an aperture formed in a first portion of the security tag at least partially spaced apart from a second portion of the security tag by a gap when the pin is in the engaged position.

13. The security tag according to claim 12, wherein the pin is fully retracted into the second portion of the security tag when the pin is in the unengaged position.

14. The security tag according to claim 12, wherein the gap is sized and shaped to prevent a user's access to the pin while the security tag is being coupled to the article at least partially inserted into the gap.

15. The security tag according to claim 10, wherein the pin is fixedly coupled to the security tag's housing.

16. The security tag according to claim 10, wherein the electro-mechanical component is a solenoid or a motor.

* * * * *